United States Patent [19]

Kittle et al.

[11] 4,440,040

[45] Apr. 3, 1984

[54] MULTIPLE MODE CONTROL LEVER ASSEMBLY

[75] Inventors: Carl E. Kittle; James E. Roach, both of Cedar Falls, Iowa

[73] Assignee: Deere & Company, Moline, Ill.

[21] Appl. No.: 333,602

[22] Filed: Dec. 23, 1981

[51] Int. Cl.[3] ..... G05G 5/06

[52] U.S. Cl. ..... 74/527; 74/531; 267/150

[58] Field of Search ..... 74/527, 529, 531, 540; 267/150

[56] References Cited

U.S. PATENT DOCUMENTS

| | | | |
|---|---|---|---|
| 2,924,680 | 2/1960 | Swenson | 200/61.3 |
| 3,721,160 | 3/1973 | Kittle | 91/426 |
| 3,779,096 | 12/1973 | Hurst et al. | 74/476 |
| 3,963,051 | 6/1976 | Kuhlmann | 137/637 |
| 4,038,508 | 7/1977 | Mapelsden | 74/531 X |
| 4,215,771 | 8/1980 | Huitema | 192/3.54 |
| 4,222,474 | 9/1980 | Choudhury et al. | 192/0.096 |
| 4,259,878 | 4/1981 | Anderson | 74/491 |

OTHER PUBLICATIONS

Exhibit Relating to Control Levers manufactured by OEM Controls, Inc., (4 pages), Jan. 1974.

*Primary Examiner*—Leslie A. Braun
*Assistant Examiner*—Frank McKenzie

[57] ABSTRACT

A multiple mode single lever control lever assembly includes a lever fixed for pivotal movement with a pivot member rotatably mounted in a housing. The pivot member includes detent recesses, a centering, spring-engaging tab and a friction disk-engaging finger. An arm is slidable in a bore in the housing, is biased towards the pivot member and carries a detent follower and a centering spring-engaging tab. A rotatable index member includes cam surfaces which cooperate with corresponding cam surfaces on the housing so that the index member moves axially to frictionally engage clutch disks with the friction disks upon rotation of the index member while a ramp surface on the index member engages the arm to uncouple the arm from the centering spring and to uncouple the detent follower from the pivot member.

22 Claims, 12 Drawing Figures

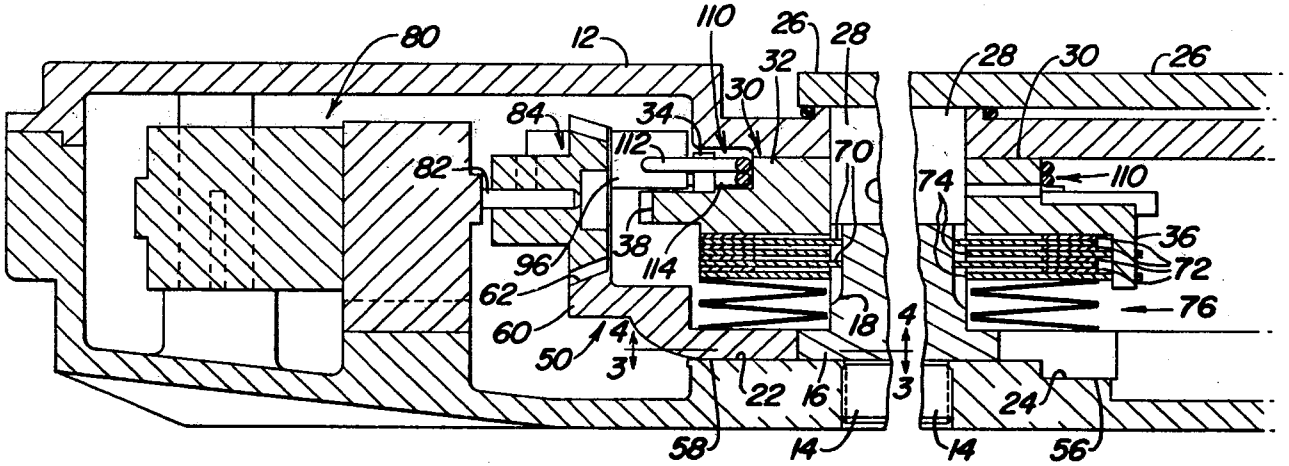
FIG. 2a
FIG. 2
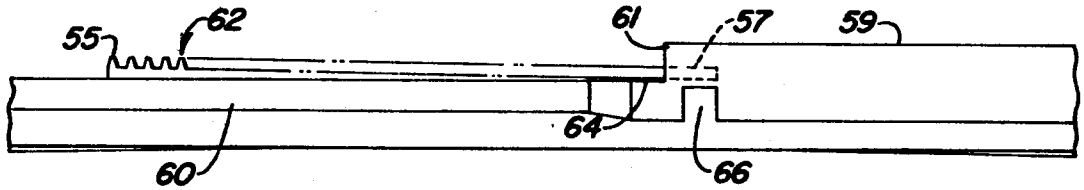
FIG. 10

FIG. 6
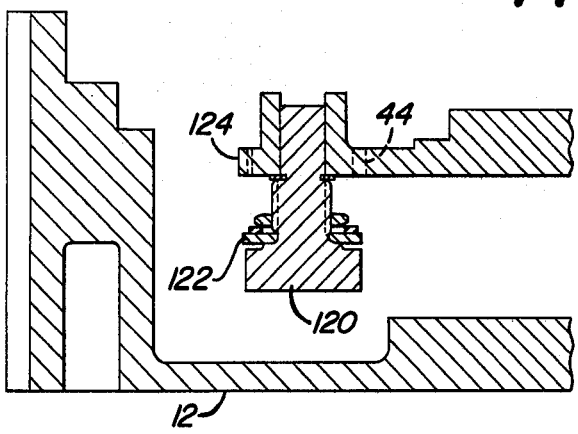
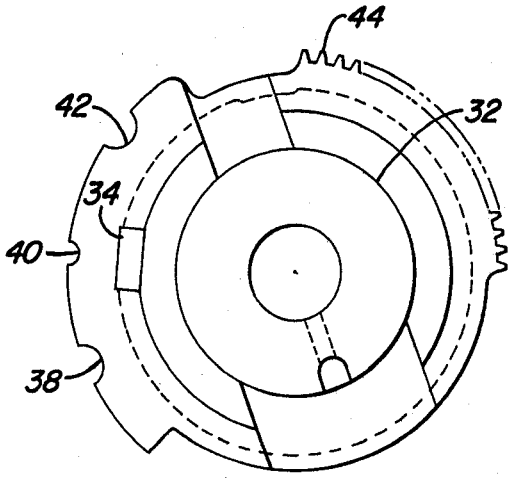
FIG. 7

MULTIPLE MODE CONTROL LEVER ASSEMBLY

BACKGROUND OF THE INVENTION

This invention relates to an operator-movable, single lever control lever assembly with friction-held, detent-held and spring-centered operational modes.

It is well-known to use manual control levers to remotely control hydraulic functions, such as hydraulic motors or cylinders. For example, friction-held control levers are used to remotely control implement hitches on agricultural vehicles wherein the control lever is moved to a friction-held displaced position to cause the hitch to raise or lower to a new position corresponding to the displaced control lever position. A friction-held control lever is also used to control the rotation speed of hydraulic motors where the rotation speed is maintained at a value corresponding to the control lever position. Spring-centered and detent-held control levers are used to control hydraulic functions through a selective control valve, as described in U.S. Pat. No. 3,721,160. In such an application, the control lever is moved to a detent-held displaced position to hydraulically extend or retract a hydraulic cylinder. When the actuated hydraulic cylinder reaches the end of its stroke, the detent is automatically released by a pressure signal and the lever returns to its neutral position under the influence of a centering spring, whereupon the cylinder is held in the extended or retracted position. Single levers with both friction-held and spring-centered operational modes are disclosed in U.S. patent applications, Ser. No. 307,704, filed Oct. 2, 1981 and Ser. No. 333,601, (attorney's file no. E-12050), filed Dec. 23, 1981, both assigned to the assignee of the present application. Although functional, both designs were subject to certain shortcomings. For example, in the first design, the mode-selecting solenoid is pivotal with the movable lever, thus subjecting the connecting electrical wires to wear from repeated flexing. Also, that design was energy-inefficient because the mode-selecting solenoid had to be constantly energized during its spring-centered operational mode. Furthermore, in that design, the friction force provided by the friction disks was somewhat less than desirable. Also, in the first design, separate actuators are required to operate the detent and centering spring mechanisms. In the second design, the centering spring is never uncoupled, thus requiring that the friction mechanism provides friction sufficient to overcome the centering spring during the friction-held operational mode. Furthermore, the second design required multiple energizations of the mode-selecting solenoid to switch between the friction and spring-centered operational modes. Accordingly, it would be desirable to provide a compact, multiple mode, single lever control lever assembly with adequate durability, improved energy utilization and with a centering spring which may be de-coupled.

SUMMARY OF THE INVENTION

An advantage of the present invention is that it provides a multiple mode control lever assembly with a friction disk-type friction mechanism and a releasable centering spring.

Another advantage of the present invention is that it provides an energy-efficient, mode-selecting mechanism.

A further advantage of the present invention is that it provides a compact multiple mode control lever assembly with a single unitary index member operatively engageable with a friction mechanism, a centering spring and a detent mechanism.

Another advantage of the present invention is that it provides a compact multiple mode control lever assembly with a single movable arm carrying a detent follower and a spring coupling member.

These and other advantages are achieved by the present invention which includes a lever fixed for rotation with a pivot member pivotally mounted in a housing. The pivot member includes a plurality of detent recesses, a first spring-engaging tab and a friction disk-engaging finger projecting therefrom. An arm is movable in the housing and carries a detent follower, a second spring-engaging tab and an index follower. A centering spring is engageable with the spring tabs to urge the pivot member from a displaced to a neutral position. An index member is mounted in the housing for rotational and axial movement therein. The index member includes a cam surface engaging a corresponding cam surface on the housing to cause axial movement of the index member upon its rotation in the housing. The index member rotates to couple and uncouple the detent and spring-centering mechanisms and moves axially to couple and uncouple the friction holding mechanism.

BRIEF DESCRIPTION OF THE DRAWINGS

FIG. 2 is a sectional view taken along lines 2—2 of FIG. 1;

FIG. 2*a* is a sectional view taken along lines 2*a*—2*a* of FIG. 1;

FIG. 6 is a sectional view along lines 6—6 of FIG. 1;

FIG. 7 is a top view of the pivot member of the present invention;

FIG. 10 is a profile view taken in the direction of arrows 10—10 of FIG. 8.

DETAILED DESCRIPTION

Figure 3:
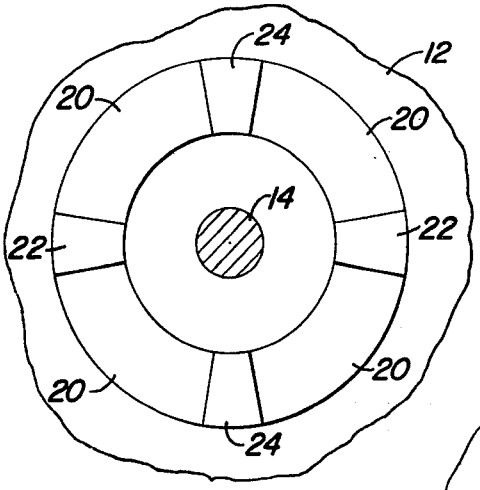
FIG. 3 is a view in the direction of arrows 3—3 of FIG. 2.

A control lever assembly 10 includes a housing 12 which threadably receives a pivot shaft 14 which includes a flange 16 and a pair of axially extending grooves 18. The axially facing surface of the housing 12 surrounding the shaft 14 includes a plurality of ramp surfaces 20 which extend between high and low cam surfaces 22 and 24, respectively, as best seen in FIGS. 2, 2*a* and 3.

Figure 1:
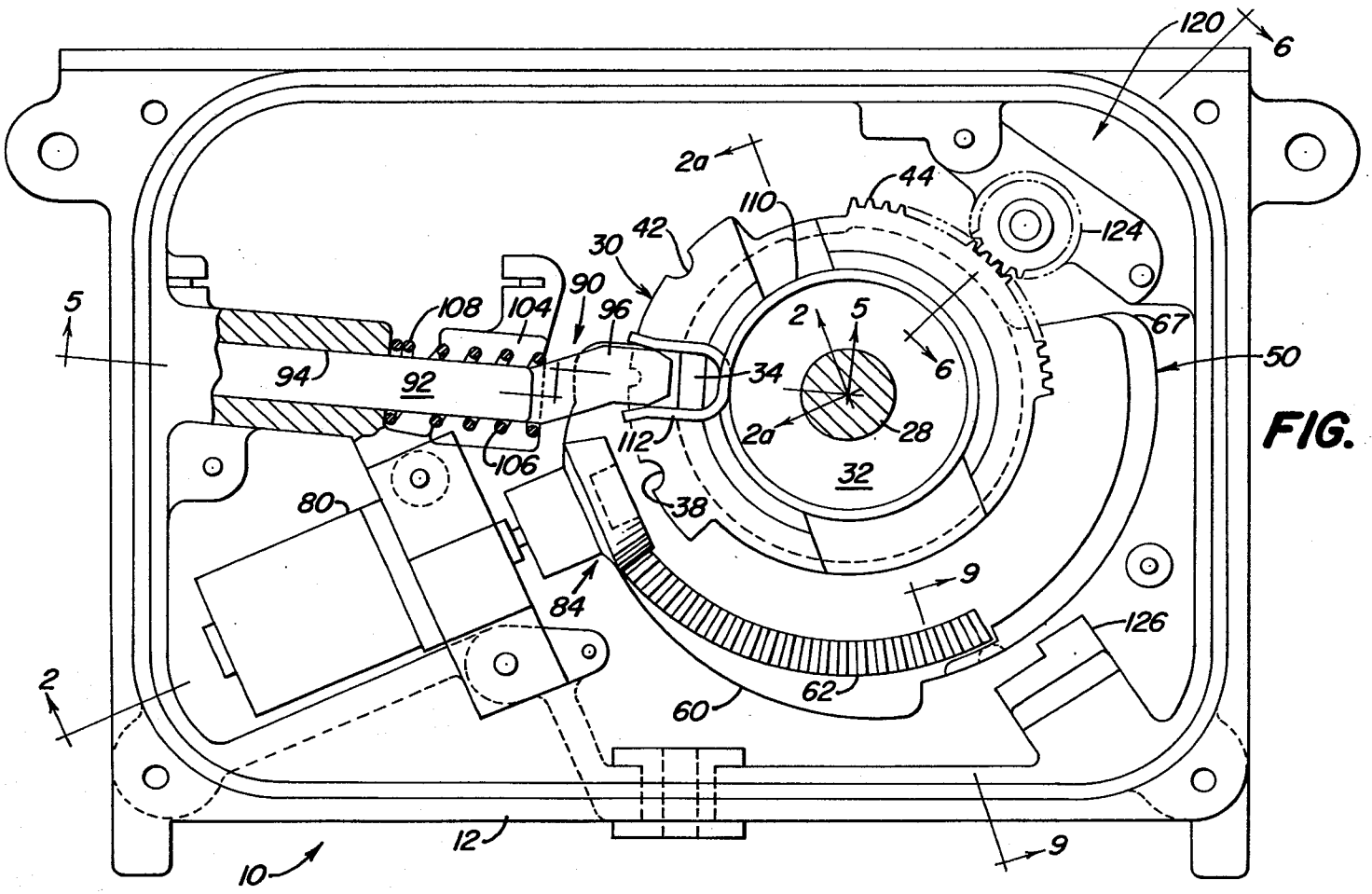
FIG. 1 is an assembly view of the present invention.
Figure 5:
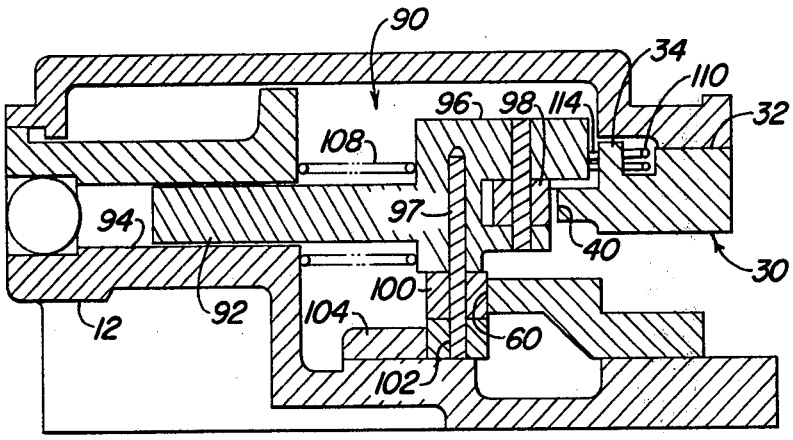
FIG. 5 is a sectional view along lines 5—5 of FIG. 1.

The housing 12 also pivotally supports a control lever handle 26 with a shaft 28 which is butted against the end of pivot shaft 14, as best seen in FIGS. 2 and 2*a*. A pivot member 30 is fixed via a pin for rotation with the shaft 28. Pivot member 30 includes a central hub 32. A lug or tab 34 is spaced apart from the hub 32 and extends axially away from the pivot member body, as best seen in FIGS. 1 and 5. A finger 36, best seen in FIG. 2*a*, extends axially from the other side of the body of pivot member 30. Detent recesss 38, 40 and 42 are formed in an outer surface of the pivot member 30. A rack of gear teeth 44 is formed in another portion of pivot member 30.

Figure 9:
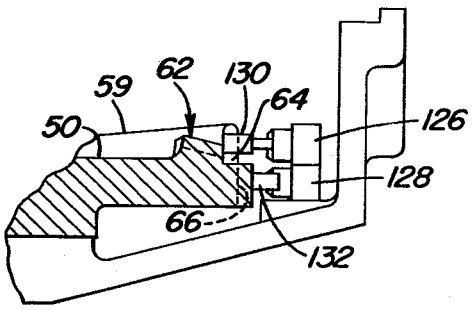
FIG. 9 is a sectional view along lines 9—9 of FIG. 1.
Figure 8:
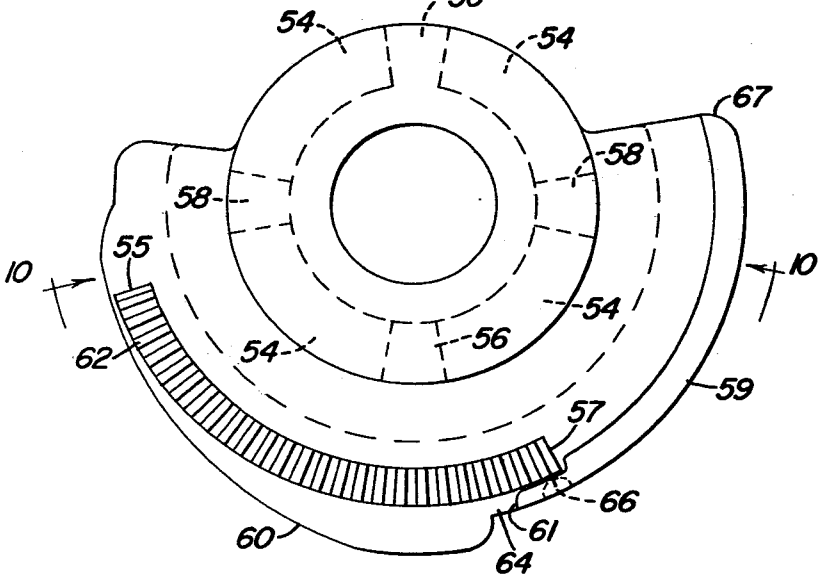
FIG. 8 is a top view of the index member of the present invention.

An index or mode select member 50 is pivotally mounted in the housing about the flange of pivot shaft 14. Index member 50 includes a central cam portion 52, best seen in FIG. 4, which includes ramp surfaces 54, high surfaces 56 and low surfaces 58 which are complimentary to and engageable with the cam surfaces 20, 22 and 24 of the housing 12. As best seen in FIGS. 1, 8 and 10, index member 50 also includes a detent controlling ramp or cam surface 60 and an inclined or sloping rack of gear teeth 62. The rack 62 slopes gradually downward from a high end 55 to a low end at 57, viewing FIGS. 8 and 10. As best seen in FIGS. 8, 9 and 10, the index member 50 also includes a ridge 59 which projects from and extends along an edge of the index member 50. The ridge terminates at an edge 61 beyond which is a space 64 which is backed by the outer edge of the rack 62. The outer peripheral surface of ridge 59 includes a notch 66.

As best seen in FIGS. 2 and 2*a*, a pair of disk-shaped friction plates 70 each carry annular friction pads 72 on opposite sides thereof. The plates 70 are fixed non-rotatably to the pivot shaft 14 via tabs which are received by the shaft grooves 18. Alternately stacked with the friction plates 70 are clutch disks or separator plates 74. Each separator plate 74 is rotatably mounted on the shaft 14 and includes a notch which receives the finger 36 of the pivot member 30, so that each separator plate 74 is constrained to rotate with the pivot member 30. A stack of Belleville washers 76 is mounted on the shaft 14 between the outer separator plate 74 and the index member 50.

A drive means, such as a reversible DC motor 80, best seen in FIGS. 1 and 2, is mounted in the housing 12 and has a gear wheel 84 non-rotatably attached to its driven shaft 82. The gear wheel 84 meshingly engages the gear rack 62 of the index member so that the index member 50 rotates as the motor shaft 82 and the gear wheel 84 spin. The slope of the rack 62 permits proper uniform meshing between gear wheel 84 and rack 62 as the index member 50 rotates and shifts axially.

Referring now to FIGS. 1 and 5, an arm 90 includes a shaft 92 which is slidably received in a bore 94 formed in part of the housing 12. A head or tab 96 on the end of shaft 92 rotatably carries a detent roller 98 for engagement with the detent recesses 38, 40 and 42. The head 96 also rotatably carries, via pin 97, an index roller 100 which engages the index cam surface 60 of the index member 50 and a guide roller 102 which slides between a pair of alignment or guide walls 104 and 106 formed by part of the housing 12. A resilient member 108, such as a coil spring, is coupled between the housing 12 and the head 96 to urge the arm 90 out of bore 94 and towards the pivot member 30 and the index member 50.

A centering spring 110 includes a coil mounted around the hub 32 of pivot member 30 and a pair of arms 112 and 114 which are disposed on opposite sides of the stub 34 of pivot member 30 and the head 96 on the arm 90, as best seen in FIG. 1.

A rotary potentiometer 120, best seen in FIGS. 1 and 6, is mounted via a bracket 122 in the housing 12 and includes a shaft-supported gear wheel 124 which meshingly engages the gear rack 44 on the pivot member 30.

A pair of micro switches 126 and 128 are fixed to the housing 12 in a stacked manner, as best seen in FIGS. 1 and 9. Micro switch 126 includes a spring-mounted roller 130 which is received by recess or space 64 when the index member 50 is in the illustrated position. Micro switch 128 includes a spring-mounted roller 132 which is receivable by recess 66, depending upon the position of the index member 50.

MODE OF OPERATION

Figure 11:
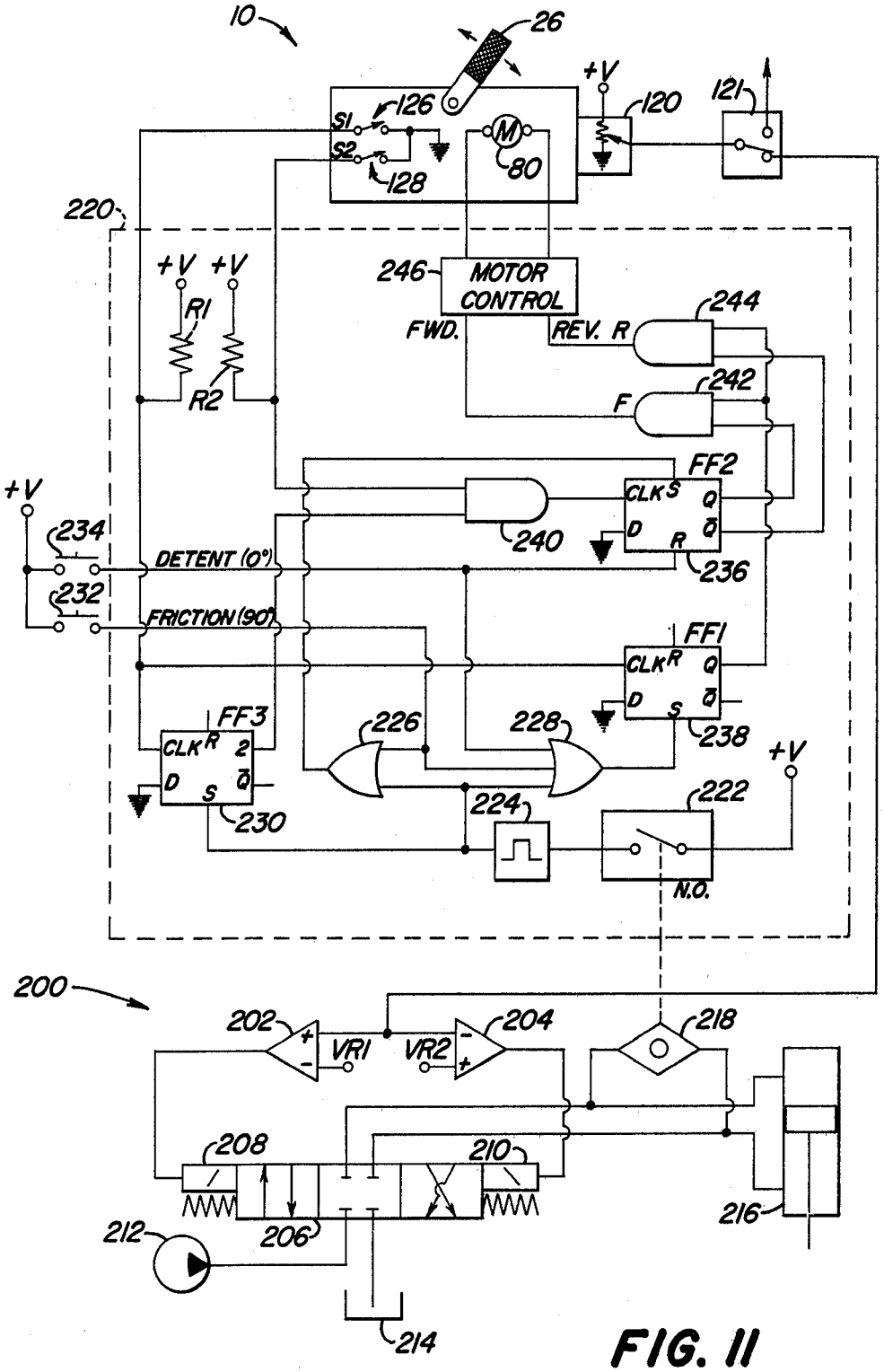
FIG. 11 is a schematic view of an exemplary system utilizing a functional mode of the present invention.

In FIG. 1, the assembly 10 is shown in its spring-centered, detent-held operational mode. This operational mode can best be described with reference to the system 200 shown in FIG. 11. The system shown in FIG. 11 is merely exemplary and forms no part of the present invention. The system 200 includes a pair of comparators 202 and 204 with (+) and (−) inputs, respectively, coupled to receive the signal from the potentiometer 120. The (−) and (+) inputs, respectively, of comparators 202 and 204 are coupled to reference voltages Vr1 and Vr2. A solenoid-operated directional control valve 206 includes solenoids 208 and 210, coupled to the outputs of comparators 202 and 204, respectively. Valve 206 controls fluid communication between pump 212, reservoir 214 and cylinder 216.

A check valve 218 communicates a pressure signal to a logic control circuit 220 which includes a normally open pressure-operated switch 222 which receives the pressure signal from check valve 218. Switch 222 is coupled to an input of a monostable multi-vibrator (or one-shot) 224. The output of one-shot 224 is coupled to an input of OR gate 226, to an input of OR gate 228 and to the set input, S, of flip-flop 230. A friction mode-selecting momentary contact switch 232 is coupled between voltage +V and an input of OR gate 226 and an input of OR gate 228. A detent mode-selecting momentary contact switch 234 is coupled between voltage +V and an input of OR gate 228 and the reset input, R, of flip-flop 236. The output of OR gate 228 is coupled to the set input, S, of flip-flop 238.

One terminal of each of switches 126 and 128 is grounded. Their other terminals are coupled to voltage +V via "pull-up" resistors R1 and R2, respectively. The ungrounded terminal of switch 126 is also coupled to the clock input, CLK, of flip-flops 230 and 238. The ungrounded terminal of switch 128 is also coupled to an input of AND gate 240. The other input of AND gate 240 is coupled to the Q output of flip-flop 230. The output of AND gate 240 is coupled to the CLK input of flip-flop 236. The output of OR gate 226 is coupled to the set input, S, of flip-flop 236. The D inputs of flip-flops 230, 236 and 238 are all grounded. The Q output of flip-flop 238 is coupled to an input of each of AND gates 242 and 244. The Q output of flip-flop 236 is coupled to an input of AND gate 242 and the $\overline{Q}$ output of flip-flop 236 is coupled to the other input of AND gate 244.

The output of AND gate 242 is coupled to the forward drive input, FWD, of a well-known transistor bridge forward-reverse D.C. motor driver 246. The output of AND gate 244 is coupled to the reverse drive input, REV, of the motor driver 246.

When it is desired to operate the control lever assembly 10 in the spring-centered and detent-held operational mode, the operator may momentarily depress switch 234. This sets flip-flop 238 via OR gate 228 and resets flip-flop 236 to thereby energize the reverse drive input, REV, of motor driver 246 via AND gate 244. This causes motor 80 to rotate index member 50 counterclockwise, viewing FIG. 1, until the index member 50 reaches the position shown in FIG. 1, wherein switch 126 opens. The opening of switch 126 pulls the CLK input of flip-flop 238 high which causes the Q output of flip-flop 238 and AND gate 244 to return to low states, thus disabling the motor driver 246 and the motor 80.

When the lever 26 is pivoted off of dead-center, the signal from potentiometer 120 turns on either comparator 202 or 204, depending upon which direction the lever 26 is pivoted. This energizes solenoid 208 or 210 to retract or extend cylinder 216. If the lever 26 is pivoted far enough, then either detent recess 38 or 42 will receive the detent roller 98 and the lever 26 will be held in its displaced position despite the centering force of spring 110.

Now, initially, in this spring-centered operational mode, switch 126 is open, switch 128 is closed and switch 222 is open and the outputs of both AND gates 242 and 244 are low and neither the forward nor reverse inputs of the motor driver 246 are energized. However, when the cylinder 216 reaches the end of its stroke, a pressure signal is communicated via check valve 218 to close the normally open pressure-operated switch 222. This sets all three flip-flops, 230, 236 and 238 and causes the output of AND gate 242 to go high, thus energizing only the forward drive input, FWD, of motor driver 246, while the output of AND gate 244 remains low.

The resulting forward rotation of motor 80 pivots the index member 50 clockwise viewing FIG. 1, with the result that cam surface 60 forces roller 100 (see FIG. 5) and detent roller 98 away from the pivot member 30, thus pulling the detent roller 98 out of the particular detent recess 38 or 42. Then, the centering spring 110 immediately returns the pivot member 30 and the control lever 26 to their initial neutral positions, whereupon the valve 206 is returned to center to prevent further movement of the cylinder 216, thus terminating the pressure signal to check valve 218 and allowing switch 222 to re-open. At this point, however, the flip-flops 236 and 238 are still set and the motor 80 continues its forward rotation.

After motor 80 has rotated the pivot member 30 approximately 10 degrees clockwise from the position shown in FIG. 1, then the roller of switch 128 will engage notch 66 and switch 128 will be opened. This pulls AND gate 240 and the CLK input of flip-flop 236 high, thus causing the Q and $\overline{Q}$ outputs of flip-flop 236 to go low and high, respectively. This causes the output of AND gate 242 to go low and causes the output of AND gate 244 to go high, thus de-energizing the forward drive input, FWD, and energizing the reverse input, REV, of motor driver 246. The reversed motor 80 rotates the index member 50 counterclockwise, viewing FIG. 1, until notch 64 engages and opens switch 126, whereupon flip-flops 230 and 238 are cleared via the low-to-high transistion applied to their CLK inputs, and whereupon the output of both AND gates 242 and 244 are once again both low and both inputs of the motor driver 246 are de-energized until another similar operational cycle is initiated by a subsequent movement of lever 26. The stack of friction elements is provided with sufficient free play such that the 10 degree movement of the index member 50 does not hinder the centering of the pivot member 30.

Figure 4:
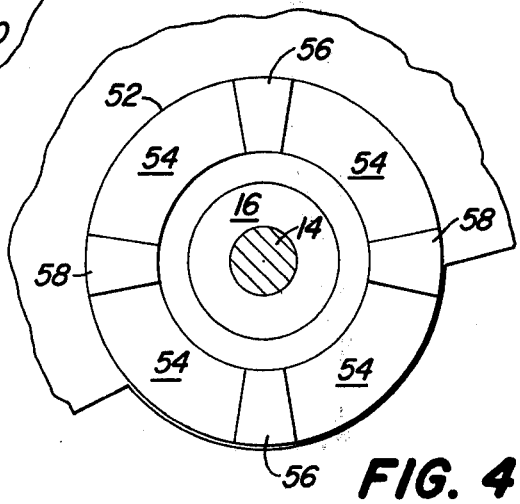
FIG. 4 is a view in the direction of arrows 4—4 of FIG. 2.

A friction-held operational mode may be selected by momentarily depressing switch 232 which sets flip-flops 238 and 236 and energizes the FWD input of motor driver 246 and causes motor 80 to rotate index member 50 clockwise, viewing FIG. 1, until the index member is rotated 90 degrees from the position shown in FIG. 1, whereupon switch 126 opens as the extreme edge 67 of index member 50 moves past the roller of switch 126. As described previously, the opening of switch 126 clears flip-flop 238, forces AND gate 242 low and de-energizes the motor driver 246. This clockwise rotation of the index member 50 causes the index member 50 to move axially upwards, viewing FIG. 2, due to the cooperation of the complimentary cam surfaces on the index member 50 and the housing 12, as shown in FIGS. 3 and 4. The upward movement of the index member acts through the stack of Belleville washers 76 to compress the stack of friction plates 70 and separator plates 74. This creates a frictional coupling between the pivot member 30 and the non-rotatable shaft 14 sufficient to hold the lever 26 and the pivot member 30 in the displaced position into which they are moved. The clockwise rotation of index member 50 also causes ramp or cam surface 60 acting on index roller 100 to move arm 90 against spring 108 and into the bore 94, viewing FIG. 5. This movement uncouples detent roller 98 from the pivot member 30 and uncouples the head 96 from the arms 112 and 114 of the centering spring 110. In this manner, neither the detent roller 98 nor the centering spring 110 interferes with the friction-held operational mode.

The control lever assembly 10 may then be operated by coupling the signal from potentiometer 120 to an electrohydraulic system with position feedback, as described in detail with respect to FIG. 8 of previously mentioned U.S. application, Ser. No. 307,704. A conventional switch 121 may be used to direct the signal from potentiometer 120 to the comparators 202 and 204 or to the error detector of the electrohydraulic system with position feedback, depending upon which hydraulic function it is desired to control via the control lever assembly 10.

We claim:

1. A multiple mode control lever assembly comprising:

a housing;

a control lever rotatably mounted in the housing;

friction means for releasably coupling with the control lever to resist the rotation thereof;

an arm movable in the housing;

resilient means for releasably coupling between the arm and the control lever to urge the control lever from a displaced position to a neutral position;

detent means for releasably coupling with the control lever to hold the control lever in the displaced position against the bias of the resilient means; and a unitary index member operatively engaging the friction means, the arm and the detent means, the index member being rotatable in the housing to couple and uncouple the friction means from the control lever, to couple and uncouple the arm from the resilient means and to couple and uncouple the detent means from the control lever.

2. The invention of claim 1, wherein: a pivot shaft rotatably supports the index member in the housing, and the friction means includes a clutch disk rotatable on the pivot shaft and fixed for rotation with the control lever and a friction disk non-rotatably mounted on the pivot shaft, the index member being axially movable on the pivot shaft to couple and uncouple the clutch and friction disks with each other.

3. The invention of claim 1, wherein:

a pivot shaft rotatably supports the index member in the housing;

the arm includes a tab projecting therefrom for engaging and disengaging with the resilient means, the arm also carrying an index follower engaging the index member; and the index member having a ramp surface engaging the index follower to cause movement of the index follower and tab radially towards and away from the pivot shaft and the resilient means upon rotation of the index member.

4. The invention of claim 3, wherein:

the arm rotatably carries a detent roller;

the control lever includes a detent recess on a peripheral surface thereof for receiving the detent follower to releasably hold the control lever in the displaced position, the engagement of the ramp surface and the index follower causing movement of the detent follower out of the detent recess upon rotation of the index member.

5. The invention of claim 1, wherein: the control lever and the index member are pivotal about a common pivotal axis.

6. The invention of claim 5, wherein: the pivot shaft slidably supports a portion of the friction means for axial movement thereon upon rotation and axial translation of the index member.

7. The invention of claim 1, further comprising:

actuator means mounted in the housing for rotating the index member in response to control signals received by the actuating means.

8. The invention of claim 7, wherein: the index member includes a rack of gear teeth formed on a peripheral surface thereof, the actuating means comprising a gear wheel operatively engaging the gear teeth and a reversible motor drive for rotating the gear wheel and the index member.

9. The invention of claim 1, wherein: the index member includes cam surfaces engaging corresponding cam surfaces on the housing to cause axial translation of the index member upon rotation of the index member, the axial translation of the index member causing coupling and uncoupling of the friction means.

10. The invention of claim 9, wherein:

the index member comprises a base rotatably supported in the housing, the base having a sloping rack of gear teeth formed on one side of the base, the rack having first and second ends projecting smaller and larger distances, respectively from the one side of the base; and the actuating means comprises a gear wheel engaging the rack of gear teeth and a reversible motor drive for rotating the gear wheel and the index member, the sloping rack permitting meshing engagement between the rack and the gear wheel during rotation and axial translation of the index member.

11. A control lever assembly comprising:

a housing;

a pivot member rotatable in the housing having a detent recess in a surface thereof and having a spring-engaging lug projecting therefrom and having a lever extending therefrom;

friction means for releasably coupling with the pivot member to resist the rotation thereof;

an arm movably mounted in the housing, the arm carrying a spring-engaging tab, a detent follower engageable with the detent recess to releasably hold the pivot member in a displaced position and an index follower;

a centering spring having arms engageable with the tab and the lug and biased to urge the pivot member from the displaced position to a neutral position;

a unitary index member operatively engaging the friction means and the index follower, the index member being rotatable in the housing to move the arm to couple and uncouple the tab and the centering spring, to couple and uncouple the detent follower and the detent recess, and to couple and uncouple the friction means and the pivot member; and transducer means operatively engaging the pivot member for generating signals indicative of the position of the pivot member.

12. The invention of claim 11, wherein: the arm includes a shaft slidably received by a bore in the housing, the arm also carrying a resilient member coupled between the arm and the housing and biased to urge the arm towards the pivot member and the centering spring.

13. A multiple mode control lever assembly comprising:

a housing;

a pivot member rotatable in the housing and non-rotatably connected to an operator movable control lever;

friction means for releasably coupling with the pivot member to resist the rotation thereof;

resilient means for releasably coupling between the pivot member and the housing to urge the pivot member from a displaced position to a neutral position;

detent means for releasably coupling with the control lever to releasably hold the pivot member in the displaced position against the bias of the resilient means; and a unitary index member operatively connected to the friction means, the resilient means and the detent means, the index member being rotatable and axially movable in the housing to couple and uncouple the friction means to and from the pivot member, to couple and uncouple the resilient means and the housing and to couple and uncouple the detent means to and from the pivot member.

14. The control assembly of claim 13, wherein: the resilient means includes an arm movably mounted in the housing, a tab projecting from the pivot member and a spring having legs engageable with the arm and the tab, the arm being movable in the housing to engage and disengage with the legs.

15. The control lever assembly of claim 14, wherein: the index member includes a ramp surface thereon, the arm carrying an index follower engaging the ramp, the engagement between the ramp and index follower causing movement of the arm upon rotation of the index member.

16. The control lever assembly of claim 2, wherein: the detent means comprises a detent roller rotatably carried by the arm and a detent recess in peripheral surface of the pivot member, the detent recess releasably receiving the detent roller when the pivot member is in its displaced position.

17. A multiple mode control lever assembly comprising:

a housing;

an operator-movable control lever having a tab projecting therefrom and having a detent recess on a peripheral surface thereof;

pivot means for rotatably supporting the control lever in the housing;

a clutch disk fixed for rotation with the control lever;

a friction disk non-rotatably mounted in the housing and engageable with the clutch disk;

an arm movably mounted in the housing, the arm having a cam follower rotatably supported therefrom, a lug projecting therefrom and a detent roller rotatably supported therefrom for engagement with the peripheral surface of the control lever;

a centering spring having a pair of arms engageable with the tab and the lug and biased to urge the control lever from a displaced position to a neutral position;

an index member rotatable and axially movable in the housing and including a first cam surface operatively engaging the cam follower to move the arm and the lug towards and away from operative engagement with the arms of the centering spring upon rotation of the index member and to move the arm and the detent follower towards and away from the peripheral surface of the control lever upon rotation of the index member, and including a second cam surface operatively engaging the housing to cause movement of the index member axially towards and away from the clutch and friction disks upon rotation of the index member.

18. The invention of claim 17, wherein: the arm includes a shaft slidably received by a bore in the housing, the arm carrying a resilient member biased to urge the arm towards the control lever and the centering spring.

19. The invention of claim 17, further comprising:

transducer means operatively engaging the control lever for generating signals indicative of the position of the control lever.

20. A multiple mode control lever assembly comprising:

a housing;

a control lever having a mounting shaft pivotally mounted in said housing;

a pivot member fixed for rotation on said mounting shaft in said housing and having at least one recess in a peripheral surface thereof and a spring-engaging lug extending therefrom;

a pivot shaft mounted in said housing coaxial to the mounting shaft;

an arm mounted in the housing for reciprocal movement generally perpendicular to the mounting shaft, said arm including a detent member engageable in said at least one recess, a spring-engaging lub (tab), and a cam follower;

means normally biasing said arm toward the pivot member;

spring means having a pair of legs straddling said tab and said lug when said arm is positioned near said pivot member to yieldably resist rotational displacement of said lug with respect to said tab upon movement of the control lever, said legs extending over said lug a distance greater than the depth of said at least one recess when said detent member is engaged in said at least one recess;

a plurality of clutch and separator plates fixed to pivot shaft and pivot member, respectively, between said pivot member and the housing; and a mode-selecting indexing ram mounted on said pivot shaft between said plates and the housing for axial and rotational movement, said cam having a first cam surface engaging said cam follower to move said arm from a position in which said detent member is engaged in said recess and said lug is extending between the pair of legs to a position in which said detent member and said lug are removed from said recess and from between said legs, respectively, upon rotational movement of said cam from a first position to a second position, said cam having a second cam surface engaging a cooperating cam surface on said housing to move said cam against said plates when said cam is rotated from its first to its second position.

21. The invention as defined in claim 20, wherein: the index cam is provided with an inclined rack of gear teeth, the gear teeth engaging a motor driven gear wheel, the motor being energizable to rotate the gear wheel and the index cam.

22. The invention as defined in claim 20, further comprising: transducer means operatively engaging the index cam for generating signals indicative of the position of the index cam.

* * * * *